United States Patent [19]

Lavi

[11] Patent Number: 4,970,839

[45] Date of Patent: Nov. 20, 1990

[54] ASSEMBLY ELEMENTS AND DECORATIVE PANEL FORMED THEREWITH

[76] Inventor: Arnon Lavi, 4 Asael St., Zahala, Israel

[21] Appl. No.: 463,729

[22] Filed: Jan. 12, 1990

[51] Int. Cl.[5] ..... E04C 01/00

[52] U.S. Cl. ..... 52/311; 52/664; 446/106; 428/116; D 25/158

[58] Field of Search ..... 52/311, 318, 664; 446/106, 125; 428/116; D 25/158, 162, 159, 160, 161, 138

[56] References Cited

U.S. PATENT DOCUMENTS

| | | | |
|---|---|---|---|
| 2,256,921 | 9/1941 | Bishop | D 25/158 X |
| 3,372,936 | 3/1968 | Sanson | 446/106 X |
| 3,501,367 | 3/1970 | Parker | 428/116 |
| 3,882,630 | 5/1975 | Bianco | 446/106 |
| 4,042,738 | 8/1977 | Gulati | 428/116 |
| 4,137,540 | 1/1979 | Mayes, Jr. et al. | 428/116 |

FOREIGN PATENT DOCUMENTS

| | | | |
|---|---|---|---|
| 2050599 | 4/1972 | Fed. Rep. of Germany | 446/125 |

*Primary Examiner*—Henry E. Raduazo
*Assistant Examiner*—Lan Mai
*Attorney, Agent, or Firm*—Benjamin J. Barish

[57] ABSTRACT

A set of like, elongated assembly elements for assembly into a decorative panel, in which each element is formed with a plurality of square notches at equally spaced intervals along its length to permit them to be assembled together according to an egg-crate configuration, with each element being further formed with a plurality of triangular notches in each side face, such that when a plurality of the elements are assembled together, the triangular notches form a plurality of openings each in the shape of a six-pointed star.

13 Claims, 2 Drawing Sheets

ASSEMBLY ELEMENTS AND DECORATIVE PANEL FORMED THEREWITH

FIELD OF THE INVENTION

The present invention relates to a set of assembly elements which may be assembled to form a decorative panel. Such decorative panels may be used in a wide variety of applications, for example as space dividers, cabinets, shelves for bookcases, ceilings, decorative windows, glass-top tables, and hot-plate supports.

It is known to provide elongated assembly elements formed with notches of square configuration extending for about one-half the thickness of the assembly element at spaced intervals along its length, to enable a plurality of such assembly elements to be assembled together in crossed relation to each other by such notches, similar to an egg-crate construction, to form decorative panels.

An object of the present invention is to provide elongated assembly elements of special configuration which may be assembled together to form decorative panels defining a plurality of specially-shaped openings, particularly openings in the shape of six-pointed stars. Another object of the invention is to provide assembly elements all of like configuration which may be used by themselves without the addition of other elements to form decorative panels of any desired length and width.

A further object of the invention is to provide elongated assembly elements of minimum thickness for producing decorative panels of maximum strength.

BRIEF SUMMARY OF THE INVENTION

According to the present invention, there is provided an elongated assembly element for use in forming a decorative panel, which assembly element includes front and rear faces defining the thickness of the assembly element and two opposed side faces defining the width of the assembly element, the assembly element being formed with: a plurality of first notches of square configuration extending for about one-half the thickness of the assembly element at spaced intervals along its length; a plurality of second notches of triangular configuration extending from one side face towards the other side face for a part of the width of the assembly element, each of the second notches being formed between each pair of the first notches closer to one of the pair than to the other of the pair; and a plurality of third notches of triangular configuration extending from the other side face of the assembly element towards the one side face for a part of the width of the assembly element, each of the third notches being formed between each pair of the first notches closer to the other of the pair than to the one of the pair. The construction is such that a plurality of the assembly elements may be assembled together in crossed relation to each other by the first notches to form a decorative panel with the second and third notches forming a plurality of shaped openings in the panel.

According to further features in the described preferred embodiment, each of the second and third notches is defined by two faces forming an angle ($\alpha$) of about 60° between them, with one face of the respective notch forming an angle ($\beta$) of about 75° to the longitudinal axis of the assembly element, and the other face of the respective notch forming an angle ($\gamma$) of about 45° to the longitudinal axis of the assembly element. Also, the side faces of the elongated elements between the second and third notches and the one notch of the pair of the square notches forms an angle ($\delta$) of about 45° to the longitudinal axis of the assembly element. Further, the side faces of the elongated elements between the second and third notches and the other notch of the pair of square notches forms an angle ($\epsilon$) of about 15° to the longitudinal axis of the assembly element. In such a construction, the plurality of shaped openings in the panel formed by assembling a plurality of the assembly elements are six-pointed stars.

According to further features in the described preferred embodiment, the two faces of each of the second and third notches, and the two side faces of the elongated element between the second and third notches and the other notch of the pair of square notches, are all of about equal length, whereby the six-pointed stars formed by assembling a plurality of the assembly elements all have sides of equal lengths; also, the square notches are equally spaced along the length of the assembly element, whereby the six-pointed stars formed by assembling a plurality of the assembly elements are equally spaced.

The invention also provides a decorative panel formed by a plurality of like assembly elements as described above.

It will thus be seen that decorative panels may be constructed of any desired width and length merely by assembling a plurality of the assembly elements as described above. Such a decorative panel defines a plurality of shaped openings in the form of six-pointed stars, and is of maximum strength for any given thickness and width of the assembly elements.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
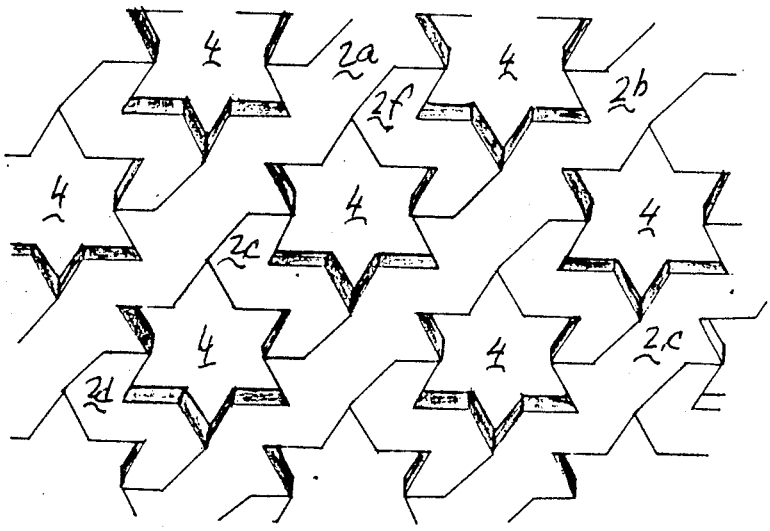
FIG. 1 is a fragmentary view illustrating one form of decorative panel constructed in accordance with the present invention.

FIG. 1 illustrates a part of a decorative panel made of an assembly of like elongated assembly elements, each designated 2, which are assembled together in crossed relation to each other, similar to an egg-crate construction, to form a plurality of shaped openings 4. Thus, the fragment of the decorative panel illustrated in FIG. 1 includes three assembly elements *2a, 2b, 2c* extending in parallel relation to each other, and assembled together with three further assembly elements *2d, 2e, 2f* extending in parallel relation to each other and substantially perpendicularly to assembly elements *2a–2c*, to define a plurality of shaped openings 4, each in the form of a six-pointed star, each opening 4 being defined between two of the elongated elements of the first group *2a–2c*, and two of the elongated elements 2d–2e of the second group.

All the assembly elements 2a–2f are of identical construction. This construction is more particularly seen in FIGS. 2–4.

Figure 2:
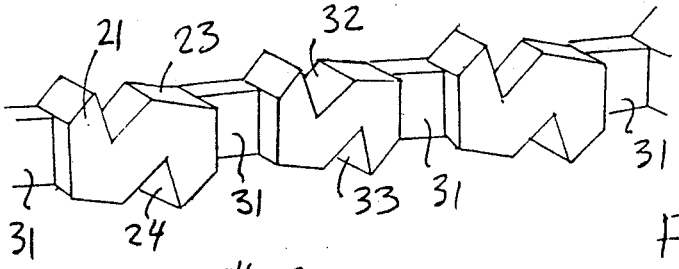
FIGS. 2 and 3 are two perspective views from different sides of the basic elongated assembly element used in assembling the decorative panel of FIG. 1.
Figure 3:
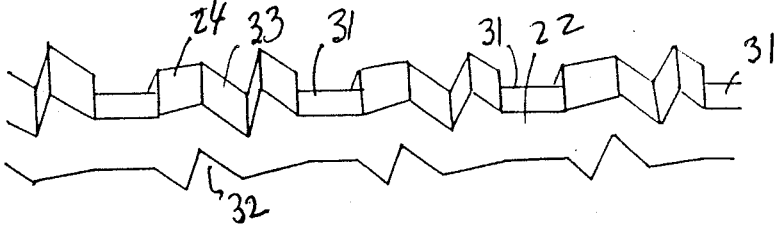
Figure 4:
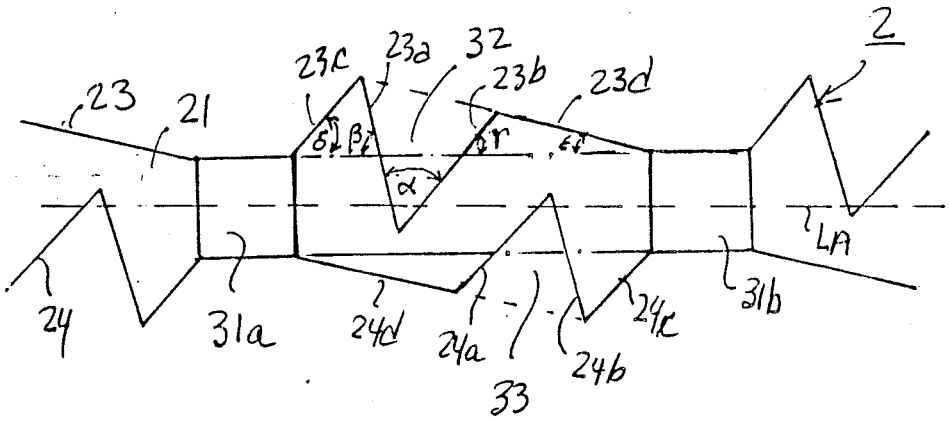
FIG. 4 is an enlarged view of the rear face of a fragment of one of the assembly elements, more particularly illustrating its construction.

Thus, each of the assembly elements, generally designated 2 in FIGS. 2–4, comprises a rear face 21 (FIG. 2), and a front face 22 (FIG. 3), which faces define the thickness of the element. Each of the assembly elements 2 further includes a pair of side faces 23 and 24, which side faces define the width of the element.

Figure 5:
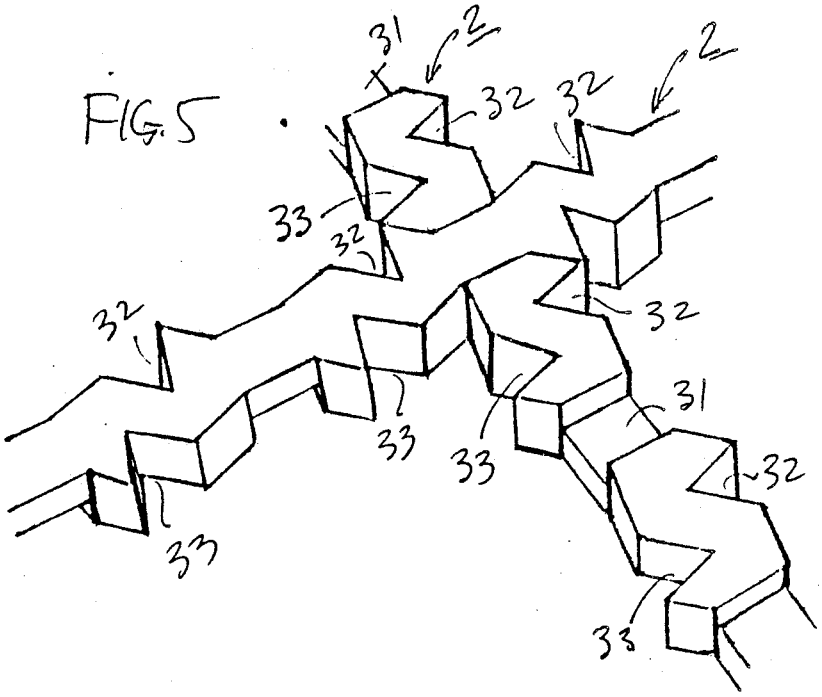
FIG. 5 is a perspective view illustrating how the assembly elements of FIGS. 2–4 may be assembled to form the decorative panel of FIG. 1.

Each of the assembly elements 2 is formed with a plurality of first notches 31 at equally spaced intervals along the length of the element. Each notch 31 extends for about one-half the thickness of the respective assembly element, so that a plurality of the assembly elements may be assembled together in cross relation by notches 31, as shown in FIG. 5, to form the decorative panel shown in FIG. 1. Each of the assembly elements 2 is further formed with a plurality of second notches 32 and third notches 33 between each pair of notches 31. The construction of each elongated element between each pair of square notches 31 is more particularly illustrated in FIG. 4, which is an enlarged view of the rear face 21 of the respective elongated element.

Thus, FIG. 4 illustrates the rear face 21 of the elongated element and the two side faces 23 and 24. It will be seen that both notches 32 and 33, formed between a pair of square notches 31a, 31b are of triangular configuration, and each extends from its respective side face for a part of the width of the elongated element. However, notch 32 is more closely spaced to square notch 31a on one side of the respective section between the pair of square notches, whereas the other triangular notch 33 formed in side face 24 is more closely spaced to notch 31b of the pair of square notches.

Notch 32 is defined by two side faces 23a, 23b at an angle ($\alpha$) which is about 60° between them. Side face 23a of notch 32 defines an angle ($\beta$) which is about 75° to the longitudinal axis LA of the elongated element, whereas its side face 23b defines an angle ($\gamma$) which is about 45° to the longitudinal axis.

The portion of the side face 23 of elongated element 2 between notch face 23a and the square notch 31a, is indicated at 23c in FIG. 4; this face forms an angle ($\delta$) which is about 45° to the longitudinal axis LA of the element. The remaining portion of the side face 23 between the two square notches 31a, 31b, namely that portion between notch face 23b and the other square notch 31b, is designated as side face 23d in FIG. 4; that side face forms an angle ($\epsilon$) to the longitudinal axis LA of the element which is about 15°.

The opposite side face 24 of the respective element formed with triangular notch 23 is similarly configured, to define the respective faces 24a, 24b, 24c and 24d, but in this case face 24c is adjacent to notch 31b of the pair of square notches, and face 24d is adjacent to square notch 31a. The angles formed by the faces 24a–24d are the same as formed by faces 23a–23d of the assembly element.

The above angles, $\alpha$, $\beta$, $\gamma$, $\delta$ and $\epsilon$ are described above as being "about" 60°, 75°, 45°, 45° and 15°, respectively, to allow for manufacturing tolerances, etc., but preferably are exactly the angles specified above. Also preferably, side faces 23a, 23b, 23d, 24a, 24b, and 24d are are all of equal length. In such a construction, a plurality of the assembly elements 2 assembled together via the square notches 31, as illustrated in FIGS. 1 and 5, define a plurality of shaped openings 4 each of the shape of a six-pointed star having sides of equal length.

The square notches 31 are preferably cut so that the elements are retained in place by a friction fit, but it will be appreciated that glue could be applied to the notches in order to firmly bond the plurality of elements in assembled relation.

It will thus be seen that decorative panels as illustrated in FIG. 1 may be constructed of any length or width by merely using any desired number of assembly elements of the same configuration as described above.

While the invention has been described with respect to one preferred embodoment, it will be appreciated that many variations, modifications and other applications of the invention may be made.

What is claimed is:

1. An elongated assembly element for use in forming a decorative panel, which assembly element includes front and rear faces defining the thickness of the assembly element and two opposed side faces defining the width of the assembly element, said assembly element being formed with:

a plurality of first notches of square configuration extending for about one-half the thickness of the assembly element at spaced intervals along its length;

a plurality of second notches of triangular configuration extending from one side face towards the other side face for a part of the width of the assembly element, each of said second notches being formed between each pair of said first notches closer to one of the pair than to the other of the pair;

and a plurality of third notches of triangular configuration extending from the other side face of the assembly element towards the one side face for a part of the width of the assembly element, each of said third notches being formed between each pair of said first notches closer to the other of the pair than to the one of the pair;

such that a plurality of said assembly elements may be assembled together by said first notches in crossed relation to each other to form a decorative panel with said second and third notches forming a plurality of shaped openings in the panel.

2. The assembly element according to claim 1, wherein each of said second and third notches is defined by two faces forming an angle ($\alpha$) of about 60° between them, with one face of the respective notch forming an angle ($\beta$) of about 75° to the longitudinal axis of the assembly element, and the other face of the respective notch forming an angle ($\gamma$) of about 45° to the longitudinal axis of the assembly element.

3. The assembly element according to claim 2, wherein the side faces of the assembly elements between said second and third notches and said one notch of the pair of said square notches forms an angle ($\delta$) of about 45° to the longitudinal axis of the assembly element.

4. The assembly element according to claim 3, wherein the side faces of the assembly elements between said second and third notches and said other notch of the pair of square notches forms an angle ($\epsilon$) of about 15° to the longitudinal axis of the assembly element, whereby the plurality of shaped openings in the panel formed by assembling a plurality of said assembly elements are six-pointed stars.

5. A decorative panel formed by a plurality of like assembly elements, each according to claim 4.

6. The assembly element according to claim 4, wherein said two faces of each of the second and third notches, and the two side faces of the elongated element between said second and third notches and said other notch of the pair of first notches, are all of about equal length, whereby the six-pointed stars formed by assembling a plurality of said assembly elements all have sides of equal lengths.

7. A decorative panel formed by a plurality of like assembly elements, each according to claim 6.

8. The assembly element according to claim 6, wherein said square notches are equally spaced along the length of the assembly element, such that the six-pointed stars formed by assembling a plurality of said assembly elements are equally spaced.

9. A decorative panel formed by a plurality of like assembly elements, each according to claim 8.

10. An elongated assembly element for us in forming a decorative panel, which assembly element includes front and rear faces defining the thickness of the assembly element and two opposed side faces defining the width of the assembly element, said assembly element being formed with:

a plurality of first notches of square configuration extending for one-half the thickness of the assembly element at equally spaced intervals along its length;

a plurality of second notches of triangular configuration extending from one side face towards the other side face for a part of the width of the assembly element, each of said second notches being formed between each pair of said first notches closer to one of the pair than to the other of the pair;

and a plurality of third notches of triangular configuration extending from the other side face of the assembly element towards the one side face for a part of the width of the assembly element, each of said third notches being formed between each pair of said first notches closer to the other of the pair than to the one of the pair;

each of said second and third notches being defined by two faces forming an angle ($\alpha$) of 60° between them, with one face of the respective notch forming an angle ($\beta$) of 75° to the longitudinal axis of the assembly element, and the other face of the respective notch forming an angle ($\gamma$) of 45° to the longitudinal axis of the assembly element;

the side faces of the assembly elements between said second and third notches and said one notch of the pair of said square notches forming an angle ($\delta$) of 45° to the longitudinal axis of the assembly element;

the side faces of the assembly elements between said second and third notches and said other notch of the pair of first notches forming an angle ($\epsilon$) of 15° to the longitudinal axis of the assembly element, whereby the plurality of shaped openings in the panel formed by assembling a plurality of said assembly elements are six-pointed stars.

11. A decorative panel formed by a plurality of like assembly elements each according to claim 10.

12. The assembly element according to claim 10, wherein said two faces of each of the second and third notches, and the two side faces of the elongated element between said second and third notches and said other notch of the pair of square notches, are all of equal length, whereby the six-pointed stars formed by assembling a plurality of said assembly elements all have sides of equal lengths.

13. A decorative panel formed by a plurality of like assembly elements each according to claim 12.

* * * * *